US005443310A

United States Patent [19]

DeFelice et al.

[11] Patent Number: 5,443,310

[45] Date of Patent: Aug. 22, 1995

[54] METHOD OF MERCHANDISING CUTTER BITS AND DISPLAY CASE THEREFOR

[75] Inventors: Thomas H. DeFelice, Canton, Ohio; Michael M. Sherman, Lockport, N.Y.

[73] Assignee: Oldham Saw Co., Inc., Burt, N.Y.

[21] Appl. No.: 161,145

[22] Filed: Dec. 2, 1993

[51] Int. Cl.[6] ..... A47B 96/00

[52] U.S. Cl. ..... 312/329; 312/117; 312/118; 206/44.11

[58] Field of Search ..... 312/138.1, 321.5, 326, 312/902, 222, 329; 211/70.6, 69; 206/44.11, 379; 144/241

[56] References Cited

U.S. PATENT DOCUMENTS

| | | | |
|---|---|---|---|
| 1,272,989 | 7/1918 | Ostram | 312/329 |
| 1,714,960 | 5/1929 | Koss | 312/118 X |
| 2,612,260 | 9/1952 | Schoenhut | 206/44.11 |
| 3,249,392 | 5/1966 | Berman | 312/118 |
| 3,892,450 | 7/1975 | Kolster et al. | 312/117 |
| 5,097,673 | 3/1992 | Negishi | 312/118 X |

*Primary Examiner*—Kenneth J. Dorner

*Assistant Examiner*—Rodney B. White

*Attorney, Agent, or Firm*—Michael Sand Co.

[57] ABSTRACT

A merchandising case adapted for displaying and storing cutter bits includes a cabinet, storage rack within the cabinet, a door movably mounted on the cabinet for concealing the storage rack, and a display rack mounted on the front of the door for holding the cutter bits on display. The display rack will retain a plurality of cutter bits on a display rack behind a transparent safety plate and above a display area. The display area has a plurality of individual receptacles, each receptacle retaining a plurality of chips each of which contains a die cut edge emulating the kerf profile created by a corresponding router bit positioned on the display rack, above the receptacle retaining the specific chip. A customer can remove one or more of the chips from the receptacle and compare it to the cutting edge of other cutter bits, or lay it against a workpiece. Once the appropriate chip is chosen by comparing a plurality of chips, the corresponding bit is purchased by opening the door of the case, and removing the appropriate bit from a plurality of bits returned on the storage rack.

21 Claims, 4 Drawing Sheets

METHOD OF MERCHANDISING CUTTER BITS AND DISPLAY CASE THEREFOR

BACKGROUND OF THE INVENTION

1. Technical Field

The invention relates generally to an improved merchandising method and associated display case. More particularly, the invention relates to the merchandising of cutter bits having a variety of profiles. Specifically, the invention relates to merchandising cutter bits having a variety of profiles wherein a sample of the bits kerf profile is provided to the customer such that the customer may use the sample profile of a given cutter bit when laying out a workpiece, and which sample also allows the customer to visualize the actual effect of a given cutter bit.

2. Background Information

It is customary in building construction, as well as in the construction of furniture and cabinetry to impart decorative profiles upon the wood. Moreover, many joints are created by imparting a variety of profiles on the wood to create stronger joint areas, as well as to provide increased surface areas for glue contact at the joint. Regardless of the reason for imparting a profile on the wood, the profile may be created in one of two methods. Hand planes may be utilized, which planes have a cutting knife shaped with the negative of the profile to be imparted on the wood. However, such planes are expensive, inaccurate, and require significant skill to utilize. As such, many power tools have been specially designed to impart a desired profile onto a workpiece while existing tools have been modified to allow those tools to also impart a desired profile.

While many such tools exist, routers are by far the most prevalent. Routers include a motor which rotates a chuck at a predetermined or variable speed. When the router operator wishes to impart a given profile onto a workpiece, the shank of a router bit having the desired profile is installed into the chuck. When the motor is activated, the router bit will rotate with each blade of the bit removing material from the workpiece creating the desired profile, Other cutting tools, such as shapers, provide a similar effect with only the connection between the cutter bit and the tool varying.

As woodworking becomes increasingly popular in the hobby market, and competition increases in the industrial market, a significant number of cutter bits, each presenting a corresponding profile, has been developed. This large number of bits makes choosing an appropriate bit difficult as often the variation between bits is small and cannot be fully appreciated simply by viewing the bit.

Cutter bits by their very nature include the negative profile of the kerf which will be imparted to the workpiece when that bit is in use. When the purchase of a relatively simple bit is being contemplated, the negative profile does not present a problem as its appearance on the workpiece is relatively easy to envision. However, when one contemplates the purchase of a bit with a relatively complicated profile, it often is difficult to envision a given bit's effect on the workpiece. Moreover, if multiple bits are to be utilized in combination to create a profile, the effect of such combinations on the workpiece is difficult to envision even for the most experienced craftsman.

Moreover, a number of bits have been introduced which present multiple profiles depending on which portion of the bit is in contact with the workpiece. Experimentation with these bits has been the only way for the purchaser of such a bit to realize the effect that various portions of the bit have on the workpiece. However, the bit must be purchased before use, making experimentation before purchase impossible.

Further, due to the large number of bits available, segregation of the bits has been difficult in the past as often only a single bit will be stocked for less common bits while the store will keep ten to twenty of the more popular bits in stock. This disparity in stocking makes segregation of the bits difficult.

Prior art merchandising display cases for cutter bits, while presumably adequate for the purpose for which they were intended, presented a number of drawbacks. The prior art was simply merchandising cases of wood or metal, covered by a sheet of plexiglass through which each bit could be viewed. Within the case a number of shelves extend the case length with the shank of each cutter extending through a corresponding hole in the shelf.

As discussed above, it is difficult for the customer to judge a given bit's profile on the workpiece when the customer is at the store. Moreover, it is difficult for a customer to differentiate between bits with similar profiles when the effect of the various bits on the workpiece cannot be compared. As such, the prior art merchandising cases did not provide a simple way for the purchaser to compare one bit relative to another; or to compare a variety of bit profiles while physically viewing the workpiece.

Still further, the prior art merchandising cases simply provided means to hold one bit in the customers The bits actually purchased by the customer had to be retained at another location thereby increasing the amount of space required to sell cutter bits. While such merchandising cases is presumably adequate for the purpose for which it was intended, the above problem increases costs of store operation. Moreover, inasmuch as router bits tend to be relatively small in comparison to other items sold by a hardware or lumber yard, often the bits are not stored such that a salesperson can easily ascertain whether a given bit was sold out, or whether it may be in stock but mixed with other cutter bits.

Stores have yet another concern when merchandising cutter bits. Bits themselves are relatively small in size and may cost in excess of one hundred dollars, making them a prime target for theft. Many current merchandising systems do little to prevent the theft of cutter bits, other than to store the bits in an area not accessible to the customer.

Thus, the need exists for a merchandising method and apparatus wherein the customer may compare the profile of a variety of cutter bits, as well as better visualize the effect a given cutter bit will have on the workpiece, even if the workpiece is too large to take to the store. Moreover, a need exists for a merchandising apparatus wherein the cutter bits are stored in the merchandising rack such that a minimum of floor space is needed to retain and merchandise the bits.

SUMMARY OF THE INVENTION

Objectives of the invention include providing a merchandising method and associated display case which allows customers to compare the profile of a plurality of cutter bits.

A further objective includes providing such a merchandising method and display case which allows the customer to visualize the effect a cutter bit will have on the workpiece in a relatively simple manner.

Another objective is to provide such a merchandising method and display case which provides the customer with means to easily compare the cutter bit profile to the workpiece when the workpiece is too large to take to the store.

Yet another objective is to provide such a merchandising method and display case wherein the variety of profiles available from a multiple profile bit may be easily visualized by the customer before the multiple profile bit is purchased.

Yet another objective is to provide such a merchandising method and display case wherein the cutter bits are stored in the display case and not at a remote location so as to minimize the floor space needed to sell cutter bits.

A still further objective is to provide a merchandising method and display case which substantially eliminates the theft of cutter bits, while still locating the cutter bits convenient to the salesperson.

A further objective is to provide such a merchandising method and display case which is of simple construction, which achieves the stated objectives in a simple, effective and inexpensive manner, and which solves problems and satisfies needs existing in the art.

These and other objectives and advantages of the invention are obtained by the improved merchandising system for merchandising and storing cutter bits in such a manner that the customer can compare the profile of respective bits and easily visualize the effect a given bits profile will have on the workpiece, the general nature of which may be stated as including a cabinet; a storage rack formed with a plurality of bit storage compartments mounted within said cabinet; display means for displaying a plurality of cutter bits; and removable comparison means emulating the profile of a cutter bit for allowing a customer to compare the profile of various cutter bits adapted to be stored in said case to each other, and to a workpiece.

These and other objectives and advantages of the invention are further obtained by the method of merchandising cutter bits comprising the steps of displaying a plurality of cutter bits in a display case; displaying a plurality of chips closely adjacent the cutter bits in the display case; providing each of the chips with an edge having a profile the same as one of the plurality of cutter bits; removing the selected one of the chips from the display case; placing the profile edge of the chip against a workpiece to assure that the cutter bit corresponding to the chips profile will create the desired profile; and purchasing the cutter bit corresponding to the chosen chip.

BRIEF DESCRIPTION OF THE DRAWINGS

A preferred embodiment of the invention, illustrative of the best mode in which the applicant has contemplated applying the principles, is set forth in the following description and is shown in the drawings and particularly and distinctly pointed out and set forth in appended claims.

Similar numerals refer to similar parts throughout the drawings.

DESCRIPTION OF THE PREFERRED EMBODIMENT

Figure 2:
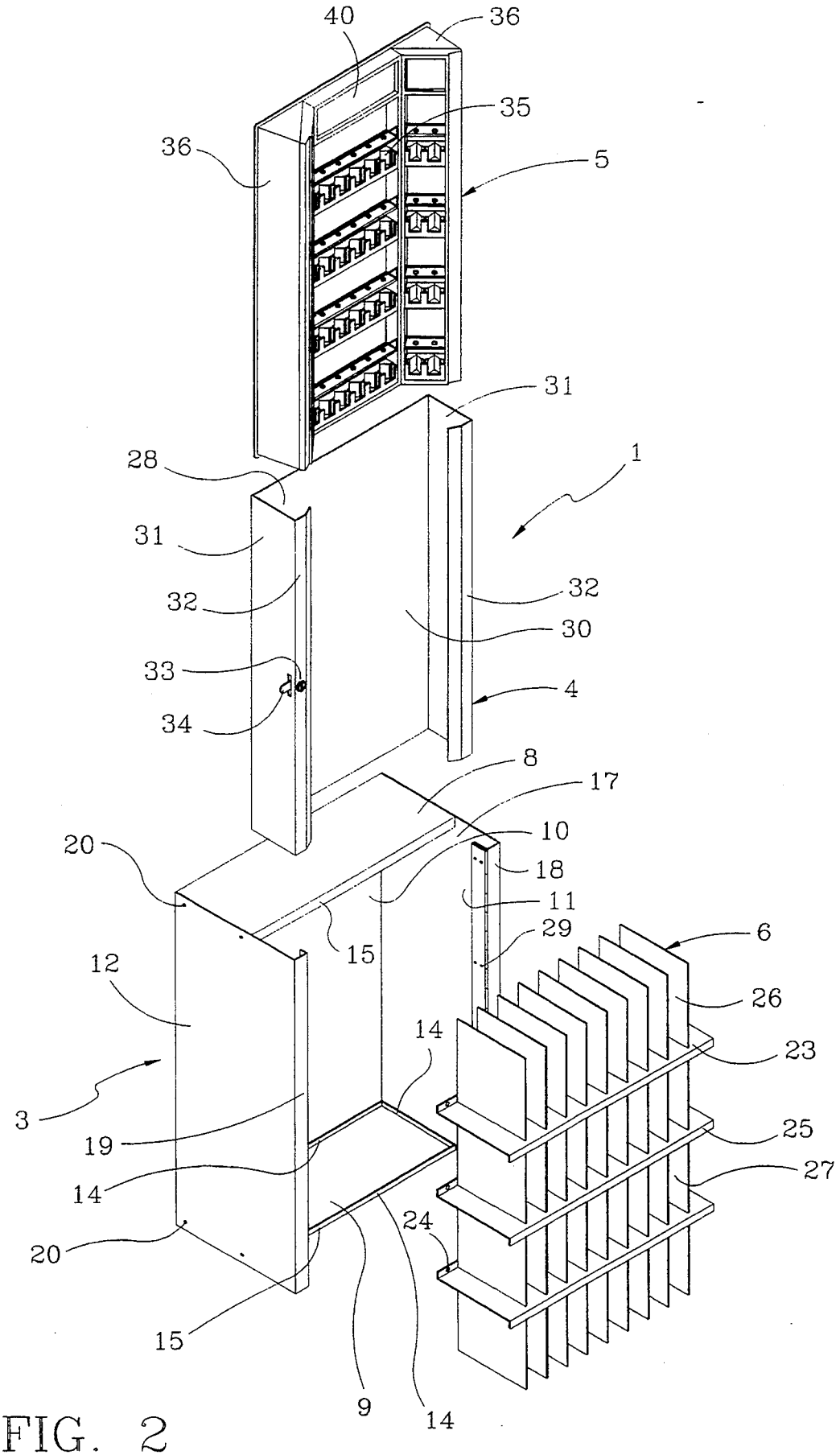
FIG. 2 is an exploded perspective view of the display case of FIG. 1.
Figure 3:
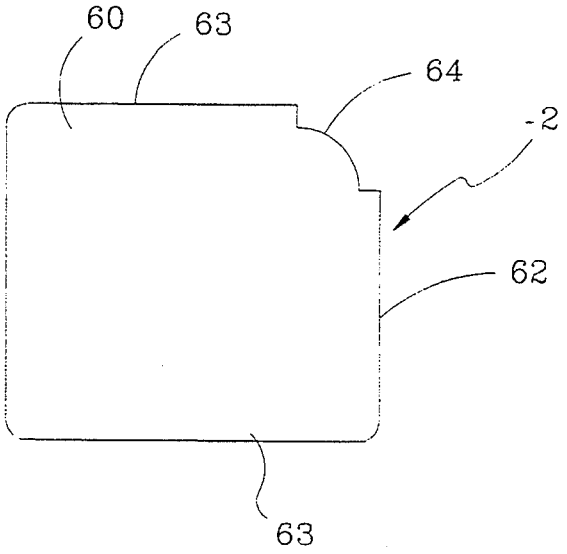
FIG. 3 is an enlarged top plan view of a sample comparison chip of merchandising method of the present invention.

The improved merchandising case of the invention is indicated generally at 1, and is adapted to hold a plurality of comparison chips, one of which is illustrated in FIG. 3 and indicated generally at 2. As best seen in FIG. 2, case 1 includes a cabinet 3, a closure door 4, a display rack 5 which is carried by door 4, and a storage rack 6.

Referring specifically to FIG. 2, cabinet 3 which preferably is formed of sheet metal, has a rear wall 10, a pair of spaced parallel sidewalls 11 and 12 extending perpendicular to rear wall 10, and a pair of spaced parallel top and bottom walls 8 and 9, respectively, which are normal to sidewalls 11 and 12 and rear wall 10. Top and bottom walls 8 and 9 include perimeter flanges 14 to add strength to the walls, a portion of which forms a front edge 15. Sidewalls 11 and 12 are wider than the top and bottom walls, and thus form a portion which extends beyond front edges 15 of walls 8 and 9 forming a recess area 17. A pair of inturned flanges 18 and 19 extend into recess area 17 from sidewalls 11 and 12 respectively. Sidewalls 11 and 12 and walls 8 and 9 may be assembled using well known techniques, but in the preferred embodiment, the cabinet is assembled using screws 20.

Storage rack 6 fits within the interior of cabinet 3 and is formed by a plurality of horizontal shelves 23, each having a rear upwardly turned flange 24 and a front downwardly turned flange 25. Flanges 24 and 25 add strength to shelves 23, and flange 24 preferably is used to attach storage rack 6 to rear wall 10 of cabinet 3. A plurality of vertical risers 26 extend between and through aligned slotted openings formed in shelves 23, and extend upwardly past the top shelf, and downwardly past the bottom shelf. The intersection of shelves 23 and risers 26 form a plurality of rectangular shaped storage compartments 27 for accepting a number of cutter bits. In the preferred embodiment, the depth of storage rack 6 equals the depth of top and bottom walls 8 and 9 such that flanges 25 and front edges 15 are substantially coplanar. However, storage rack 6 could be narrower than walls 8 and 9 without departing from the spirit of the present invention.

As should be apparent to one of ordinary skill in the art, the number of shelves 23 or risers 26 may vary and the dimensions of cabinet 3 may vary, without departing from the spirit of the present invention. Shelves 23 and risers 26 preferably will be formed of sheet metal and are fabricated by usual construction techniques.

Figure 1:
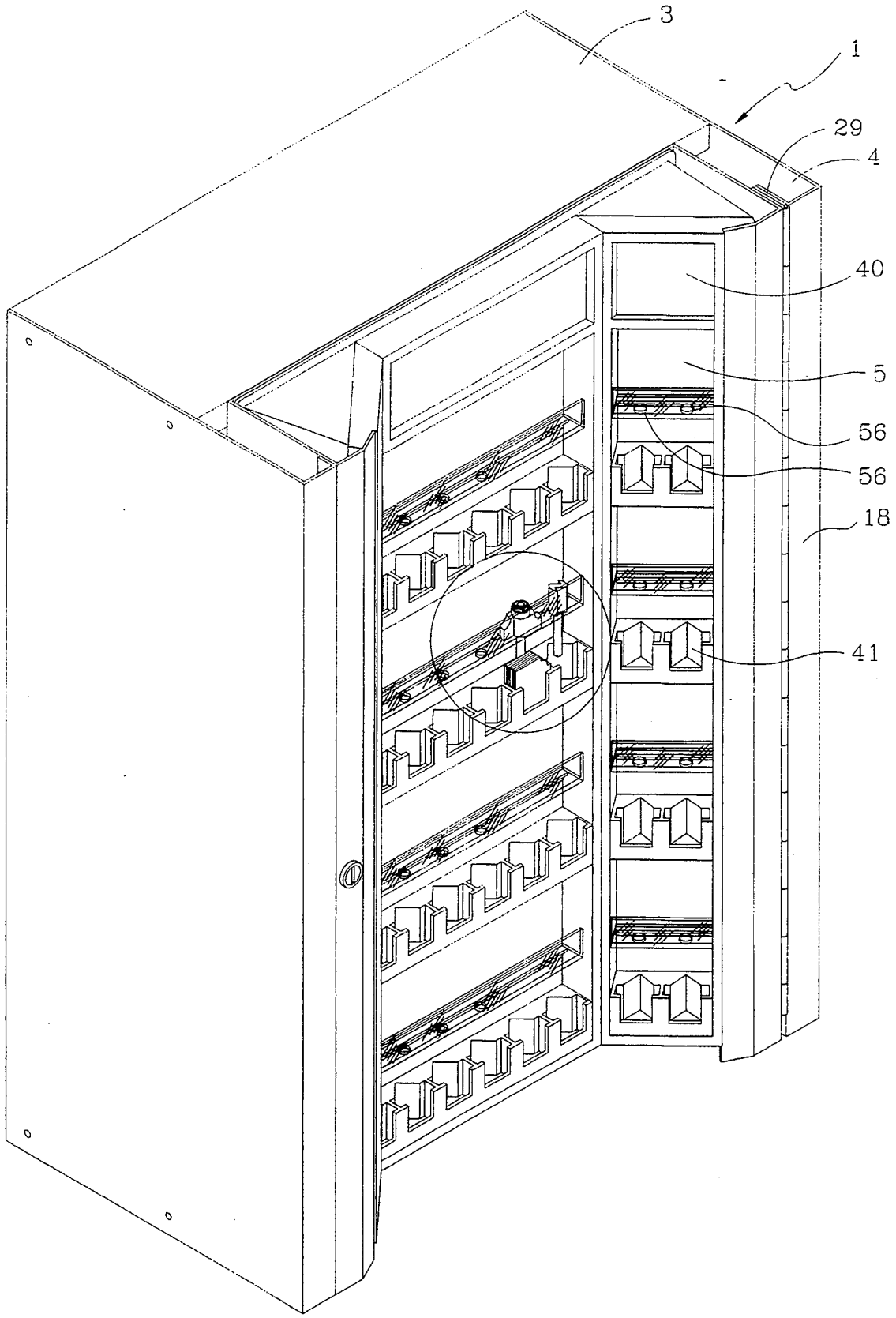
FIG. 1 is a perspective view of the merchandising display case of the present invention with the door shown in the closed position.
Figure 5:
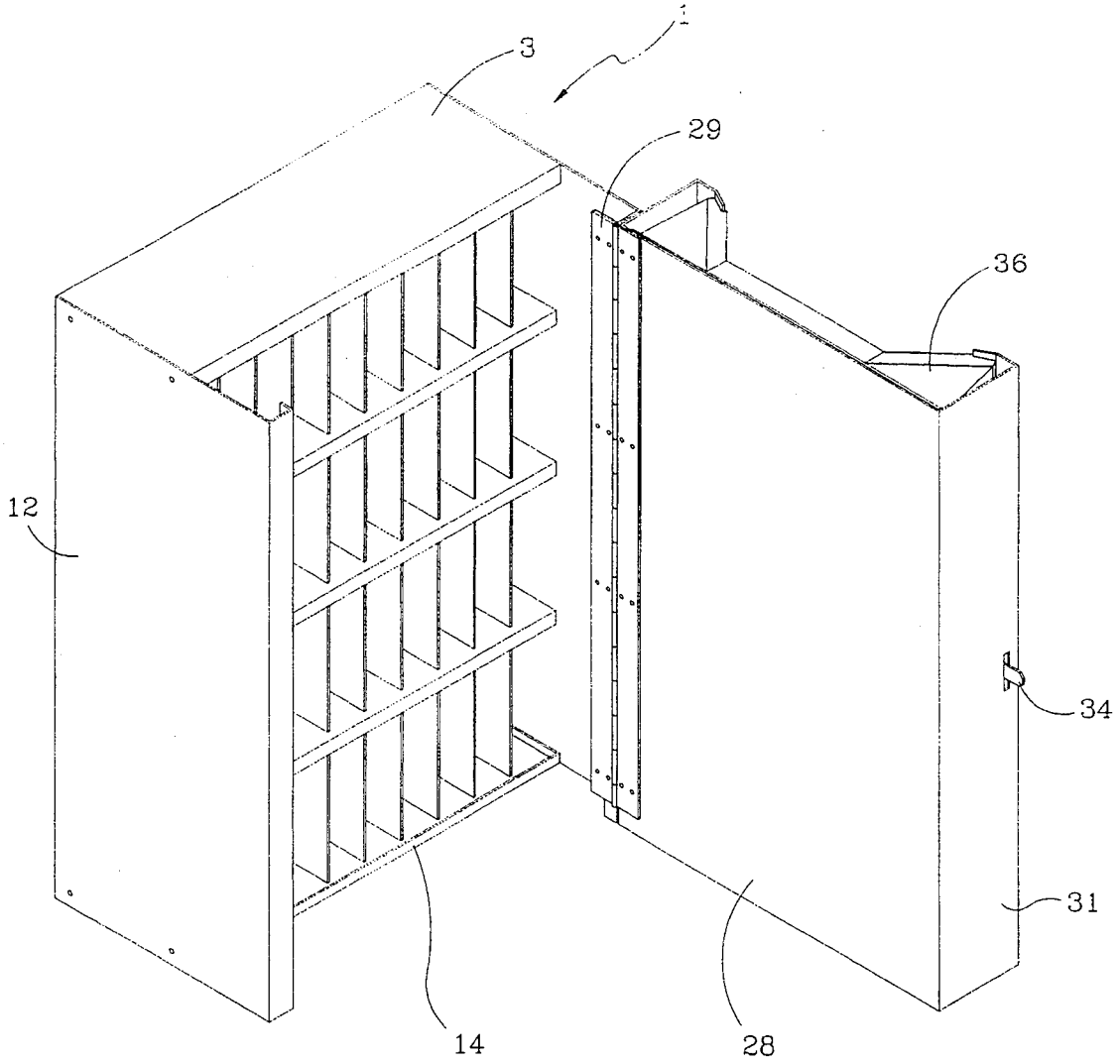
FIG. 5 is a perspective view of the display case with the door in the open position.

Door 4 is channel shaped and is movable between open and closed positions with respect to cabinet 3 as shown in FIGS. 5 and 1 respectively. Door 4 preferably is formed of sheet metal and is attached to cabinet 3 via a piano hinge 29 which is attached to the inturned portion of flange 18 (FIGS. 1 and 2). Door 4 is complementarily shaped with recess 17 such that recess 17 accepts door 4 when in the closed position. Door 4 includes a pair of spaced parallel sidewalls 31 and a rear wall 30. An outer free end of each sidewall 31 has an inturned flange 32 which form a pair of spaced parallel slide channels 28. A lock 33 is provided in door 4 with a locking pawl 34 extending through one sidewall 31 to engage cabinet 3.

Display rack 5 is slidably mounted in slide channels 28 of door 4 and is preferably an integrally formed one-piece plastic member having a width substantially equal to the width of rear wall 30 of door 4. Rack 5 includes a display wall 35 and a pair of spaced apart sidewalls 36. Display rack also includes a plurality of top display areas 40 onto which a variety of sales information may be mounted.

Figure 4:
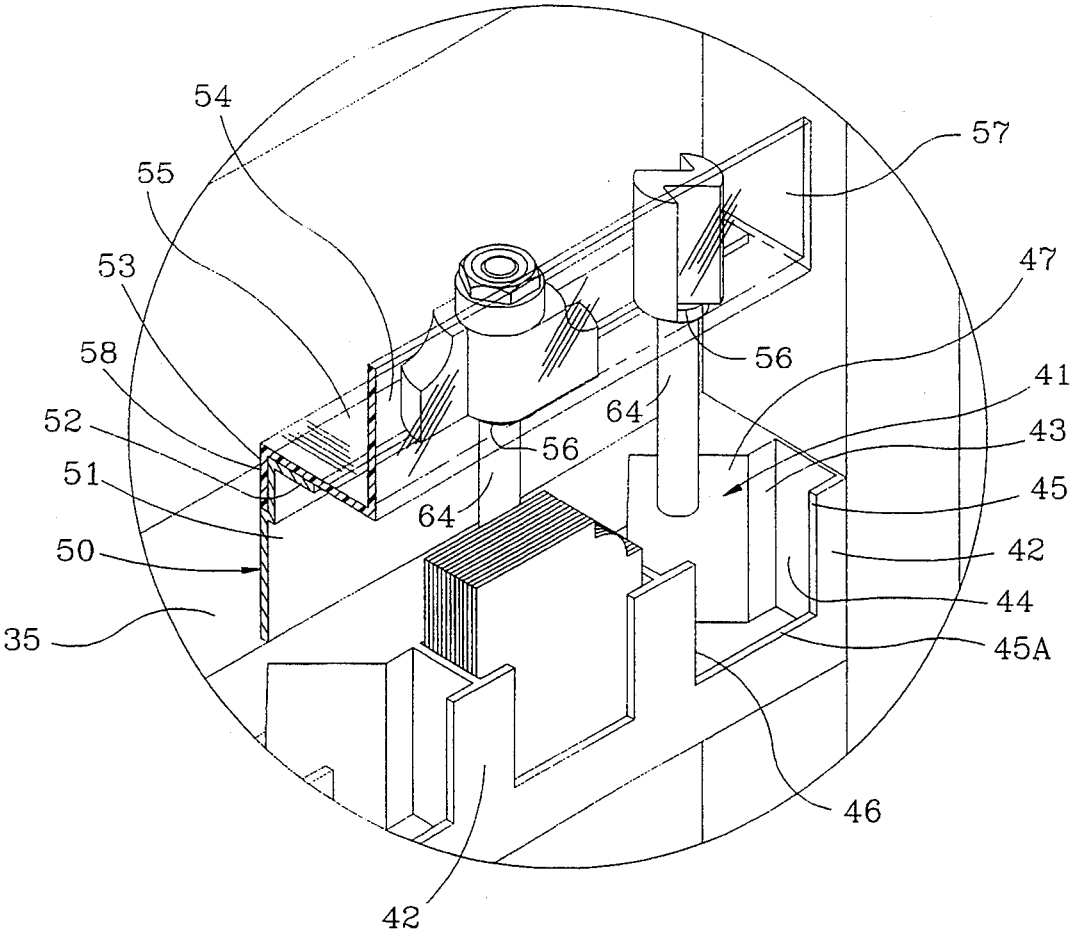
FIG. 4 is an enlarged perspective view of a portion of the encircled portion of FIG. 1 with portions in section.

In accordance with one of the main features of the present invention, display wall 35 includes a plurality of bit display areas 41 as best seen in FIG. 4. Each bit display area 41 includes a front wall 42, a rear wall 43, and a pair of spaced apart sidewalls 44, which walls form a receptacle 45. Receptacle 45 retains a plurality of comparison chips 2 for display and for subsequent removal by a customer. Front wall 42 includes an access opening 45A defined by a substantially U-shaped perimeter wall 46. Access opening 45A allows the customer to grasp and remove a chip, for purposes which will be described in detail hereinbelow. Rear wall 43 is substantially parallel to front wall 42, and includes a V-shaped recess 47 extending from the center thereof, toward display wall 35.

A substantially L-shaped support bracket 50 is attached to display wall 35 above each row of bit display areas 41. Each support bracket 50 has a first leg 51 attached to display wall 35 and a second leg 52 substantially perpendicular to first leg 51, extending outwardly from a top edge of first leg 51. A groove 53 is formed between leg 51 and wall 35 and extends along the entire length thereof.

A display bracket indicated generally at 54, extends outwardly above bit display areas 41 and includes a central portion 55 substantially parallel to, and supported by second leg 52 of support bracket 50. Central portion 55 includes a plurality of equally spaced holes 56 (FIG. 1) which accept the shanks 64 of cutter bits 65. Each hole 56 is positioned directly above a respective V-shaped recess 47, such that when the bit shank is placed within hole 56, it extends into V-shaped recess 47. A safety plate 57 extends upwardly from, and substantially normal to, central portion 55 to protect the customer from the sharp cutting edge of the cutter bit positioned behind the plate and on top of center portion 55. Central portion 55 also includes a support leg 58 which is complementarily shaped to groove 53 and extends into groove 53 for display bracket 54 on wall 35. Preferably bracket 54 is formed as a one-piece member of a clear plastic material.

As should be apparent to one of ordinary skill in the art, the number of bit display areas 41 that are provided in display rack 5 may vary without departing from the spirit of the present invention. Moreover, holes 56 may be sized to accept a variety of cutter bit shank sizes.

When assembled, storage rack 6 is installed into cabinet 3 such that flanges 25 are coplanar with front edge 15 of end walls 13. Thereafter, door 4 is attached to piano hinge 29 and positioned within recess 17. Display rack 5 is slidably mounted behind flanges 32 of door 4 such that rack 5 is supported between rear wall 30 and flanges 32 and also between sidewalls 31. A variety of cutter bits are then placed within a respective hole 56 behind safety plate 57. Similarly, a plurality of chips 2 are placed within each bit display area within receptacle 45. Thereafter, storage rack 6 is stocked with bits for resale.

Referring to FIG. 3 and in accordance with one of the main features of the present invention, there is shown a chip 2 of the present invention. Chip 2 includes a pair of flat planar faces 60, a pair of spaced apart side edges 62 and a pair of spaced apart end edges 63. Chips 2 are mass produced from a variety of very inexpensive materials, such as various plastics, wood, press board, etc. In the preferred embodiment, chip 2 is manufactured from die cut polystyrene, although any convenient material may be used without departing from the spirit of the present invention. Chip 2 includes a die cut edge 64 corresponding to the kerf profile created by the particular bit positioned above chip 2 in the bit display area. Edge 64 may have any profile corresponding to the kerf profile formed by a cutter bit. Moreover, edge 64 may include an entire side edge 62 and end edge 63, or a portion thereof depending of the size and profile of bit to be represented.

When a customer approaches case 1, the customer will review the various cutter bits offered for sale and displayed in holes 56 of bracket 54, and after narrowing the choice of bits for a particular task, will remove chips 2 corresponding to the chosen bits. When the customer has located the chips 2 corresponding to the chosen bits, the customer will then be better able to visualize the exact profile of a given bit as the kerf profile formed by the bit is shown on the die cut edge 64 of chip 2. After viewing the appropriate chips, the consumer may then purchase the desired bit.

Alternatively, since the chips are extremely inexpensive, the chips may be removed from the store by a customer and taken to the workpiece and placed thereagainst to visualize the exact effect the bit will have on the workpiece. This is particularly helpful if the customer contemplates the purchase of multiple profile cutter bits. Specifically, the consumer may reposition the chips to various points in the bits profile as represented on edge 64, to review the cut edge of the bit with relation to the workpiece. Similarly, chips 2 may be utilized when a plurality of bits will be combined to form a unique edge treatment on the workpiece.

Thus, as shown in FIG. 1, an attractive display case is presented to the customer securely and safely holding a plurality of different sized cutter bits with a plurality of extremely inexpensive removable comparison chips to being located in storage receptacle 45 adjacent the corresponding cutter bit. This enables the customer to easily view all of the individual shapes and styles of cutter bits and by viewing the comparison chip can determine the contour resulting from the use of the adjacent cutter bit. Furthermore, should the customer not desire to purchase the cutter bit initially, the customer can then take one or more of the different comparison chips to the location of the workpiece.

Furthermore, the sales clerk merely needs to unlock door 4 and move it to the open position as shown in FIG. 5 in which position the salesperson has easy access to the storage compartments formed by storage rack 6 in which a plurality of the cutter bits only one of which is displayed in display case 6 are stored for subsequent sale.

Display case 1 provides a relatively theft proof cabinet in that the displayed cutter bits 65 could be if desired secured in their display position preventing their removal from the display rack completely eliminating any possibility of theft of either the displayed cutter bit or the cutter bits stored in storage rack 6 behind security door 4.

Furthermore, the method of the present invention enables a customer to easily select a desired cutter bit either initially or eventually which will provide the desired contour cut when used on a workpiece eliminating guess work as heretofore required when purchasing cutter bits.

Accordingly, the improved merchandising case, and associated method of operation is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved display case is constructed and used, the characteristics of the construction, and the advantageous, new and useful results obtained; the new and useful structures, devices, elements, arrangements, parts and combinations, and method steps are set forth in the appended claims.

We claim:

1. A display case for displaying and storing and storing cutter bits comprising:

a cabinet;

a storage rack formed with a plurality of bit storage compartments mounted within said cabinet;

display means for displaying a plurality of cutter bits and securing said cutter bits against removal by a customer;

removable comparison means simulating the profile of an associated cutter bit for allowing a customer to compare the profile of the associated cutter bit adapted to be stored in said case to other cutter bits, and to a workpiece without the customer contacting the cutter bit; and at least one receptacle formed in the display means adjacent each cutter bit displayed in the display means for retaining the plurality of removable comparison means.

2. A display case as defined in claim 1 in which the cabinet further comprises a door hingedly attached to the cabinet.

3. A display case as defined in claim 2 in which the door further comprises lock means for locking the door in a closed position.

4. A display case as defined in claim 2 in which the door further comprises support means for supporting the display means.

5. A display case as defined in claim 1 in which said comparison means includes a plurality of generally flat planar chips; and in which a cutter bit profile is formed in an edge of each chip.

6. A display case as defined in claim 5 in which the chips are die cut polystyrene.

7. A display case for displaying and storing and storing cutter bits comprising:

a cabinet;

a storage rack formed with a plurality of bit storage compartments mounted within said cabinet;

display means for displaying a plurality of cutter bits against removal by a customer;

removable comparison means emulating the profile of a cutter bit for allowing a customer to compare the profile of various cutter bits adapted to be stored in said case to each other, and to a workpiece, whereby said comparison means includes a plurality of generally flat planar chips having a cutter bit profile formed in an edge of each of said chips; and the display means including at least one receptacle for retaining a plurality of the chips.

8. A display case as defined in claim 7 in which the display means includes retaining means for retaining the cutter bits.

9. A display case as defined in claim 8 in which said retaining means further comprises a display bracket extending outwardly from a rear wall of the display means; and in which a plurality of holes are formed in the display bracket for accepting the shanks of cutter bits.

10. A display case as defined in claim 9 in which the display means further includes a safety means for covering at least a portion of a cutting surface of the bit when a bit is mounted on the display bracket.

11. A display case as defined in claim 10 in which the safety means includes a transparent plate adapted to extend between the cutter bit and a customer; and in which the plate is at least partially transparent to allow a customer to view the cutter bit.

12. A display case as defined in claim 11 in which the holes extending though the display bracket are spaced such that one hole extends through the display bracket adjacent each receptacle.

13. A display case as defined in claim 11 in which the display bracket is mounted above the receptacles.

14. A display case as defined in claim 1 in which the cabinet has a rear wall, a pair of spaced apart sidewalls, and spaced apart top and bottom walls; in which the storage rack has a plurality of horizontal shelves and a plurality of vertical risers which form the bit storage compartments; and in which said storage rack is secured within the cabinet by the door.

15. A display case as defined in claim 14 in which the display means is mounted on a door which is movably mounted on the cabinet; and in which the door is substantially channel shaped having a rear wall and spaced apart sidewalls, and wherein the sidewalls include flanges extending toward each other from a free end of the sidewalls to form slide channels for slidably receiving the display means therein.

16. A merchandising case as defined in claim 15 in which the display means includes a rear wall and spaced sidewalls; and in which the sidewalls are mounted behind the flanges to retain the display means between said flanges and rear wall.

17. A method of displaying and storing cutter bits comprising the steps of:

displaying a plurality of cutter bits in a display case;

displaying a plurality of chips in a receptacle located closely adjacent the cutter bits in the display case;

storing a plurality of cutter bits corresponding to the plurality of cutter bits in the display case;

providing each of the chips with an edge having a profile the same as one of the plurality of cutter bits;

removing the selected one of the chips from the display case while the cutter bit remains displayed in the display case;

placing the profile edge of the chip against a workpiece to assure that the cutter bit corresponding to the chips profile will create the desired profile; and selecting the cutter bit from the plurality of stored cutter bits, corresponding to the chosen chip.

18. A method of merchandising cutter bits as described in claim 17, comprising the further steps of placing a plurality of chips against a workpiece to consider the effect of the associated cutter bits on a workpiece when said bits are used in combination to create an edge treatment on a workpiece.

19. A method of merchandising cutter bits as described in claim 17 including the steps of providing a concealed storage compartment in the display case; storing a plurality of cutter bits corresponding to the cutter bits displayed in the display case in the storage compartment; and providing a secured access to said storage compartment to remove a stored cutter bit therefrom for sale to a customer.

20. A method of displaying and storing cutter bits comprising the steps of:

displaying a plurality of cutter bits in a display case;

displaying a plurality of chips closely adjacent the cutter bits and the display case;

providing a concealed storage compartment in the display case;

storing a plurality of cutter bits corresponding to the cutter bits displayed in the display case in the storage compartment;

providing each of the chips with an edge having a profile the same as one of the plurality of cutter bits;

removing the selected one of the chips from the display case;

placing the profile edge of the chip against a workpiece to assure that the cutter bit corresponding to the chip profile will create the desired profile;

providing a secured access to said storage compartment therefrom for sale to a customer; and selecting the cutter bit corresponding to the chosen bit.

21. A method of displaying and storing cutter bits as described in claim 20 including the step of shielding the cutter bits from contact by a customer upon said customer removing a chip from the display case.

* * * * *